United States Patent [19]

Stahl et al.

[11] 4,211,327

[45] Jul. 8, 1980

[54] STACK AND NEST CONTAINER

[75] Inventors: Edward L. Stahl, Richmond, Mich.; Ellsworth E. Sanders, Naples, Fla.; George C. Blair, Kansas City, Mo.

[73] Assignee: Pinckney Molded Plastics, Inc., Pinckney, Mich.

[21] Appl. No.: 920,484

[22] Filed: Jun. 29, 1978

[51] Int. Cl.[2] ..... B65D 21/02

[52] U.S. Cl. ..... 206/505

[58] Field of Search ..... 206/505, 506, 507

[56] References Cited

U.S. PATENT DOCUMENTS

| | | | |
|---|---|---|---|
| 3,398,840 | 8/1968 | Wilson | 206/505 |
| 3,404,804 | 10/1968 | Frater | 206/505 |
| 4,007,839 | 2/1977 | Stahl | 220/23.83 |

*Primary Examiner*—George E. Lowrance

*Attorney, Agent, or Firm*—Whittemore, Hulbert & Belknap

[57] ABSTRACT

A container adapted to either stack or nest with another similarly oriented container of identical construction. The container has a plurality of feet along each side adjacent the bottom. The container side walls each have a lower section and an upper section spaced outwardly from the lower section and joined thereto by a ledge providing nesting saddles directly above the feet. The container also has a plurality of stacking saddles along the upper edge of each side wall likewise postioned directly above the feet. There are inclined ridges in the upper and lower sections of each side wall which guide the container down to a nested position within a lower container of identical construction.

10 Claims, 16 Drawing Figures

STACK AND NEST CONTAINER

SUMMARY OF THE INVENTION

The container of this invention will either stack or nest with a similarly oriented container of identical construction. The container has a bottom and side walls projecting upwardly from opposite side edges of the bottom. Each side wall has a lower section and an upper section spaced outwardly from the lower section and joined thereto by a ledge. The upper wall sections are spaced apart sufficiently farther than the lower wall sections to permit the container to nest in a lower container of identical construction.

The container has a plurality of feet spaced from one another along the lower edge portion of each side wall. The ledges have nesting saddle portions directly above the feet which are adapted to support the feet of an upper identical container nested therewith.

A plurality of stacking saddles along the upper edge of each side wall support the feet of an upper identical container stacked thereon.

The container side walls have inclined ridges both in the upper and lower wall sections which serve to guide the container down to a nesting position with respect to an identical lower container.

The feet of the container are provided with pilot extensions which are engageable with the stacking saddles when the container is placed over a lower container of identical construction in preparation for movement to the nested position. These pilot extensions serve as additional means of support when two containers are nested together.

The container of this invention is designed to enable it to be either stacked or nested with another container of identical construction without turning or rotating, as is necessary with containers of other designs.

The container also provides additional support when nested so that a greater number of containers can be tiered within a given vertical dimension.

The container is designed to enable a movement to nested position with only a slight reduction in the height of the front wall of the container. Nesting of similarly oriented containers of other designs often require that the front wall be almost completely eliminated for clearance purposes. The container of this invention has a front wall of substantial height at least at the sides which provides better support for the container side walls.

Other objects and features of this invention will become more apparent as this description proceeds, especially when taken in conjunction with the accompanying drawings, wherein.

Figure 1:
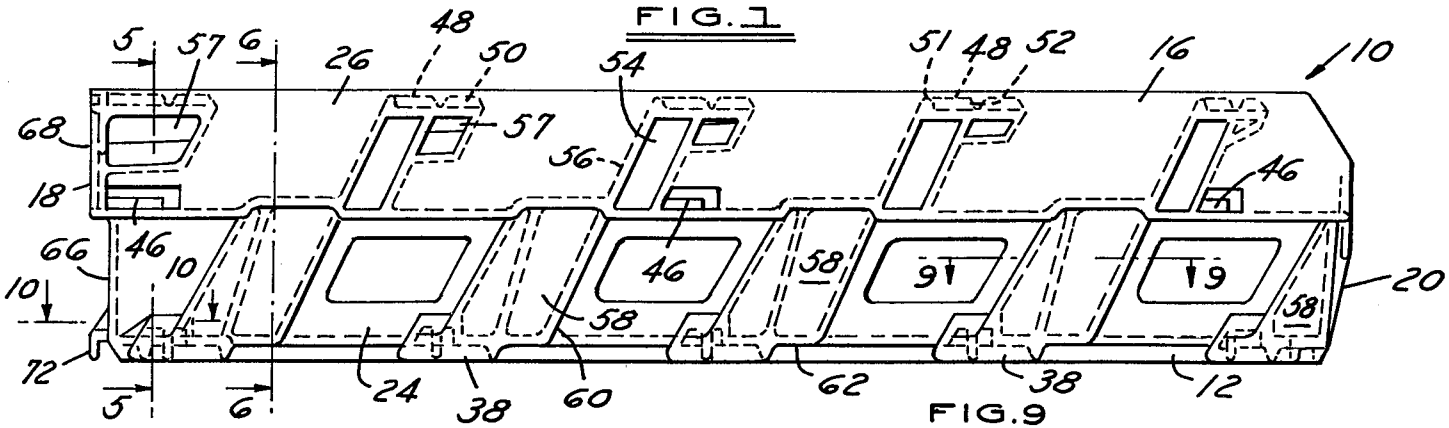
FIG. 1 is a side elevational view of a container constructed in accordance with the invention.
Figure 9:
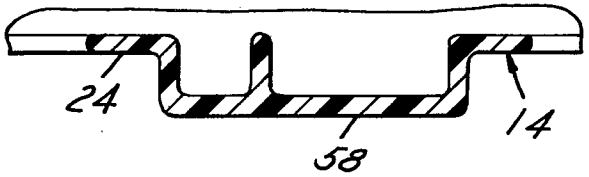
FIG. 9 is a fragmentary sectional view taken on the line 9—9 in FIG. 1.
Figure 10:
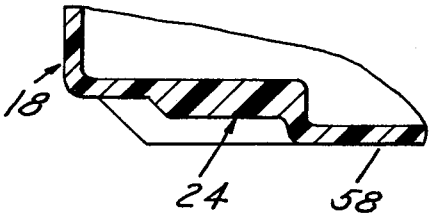
FIG. 10 is a fragmentary sectional view taken on the line 10—10 in FIG. 1.

Referring now more particularly to the drawings, the container there shown is preferably of one-piece molded construction formed of a suitable plastic material such as polyethylene or polypropylene. The container is generally designated by the reference numeral 10 and is shown in some of the views with a second container of identical construction.

The container 10 has a horizontal rectangular bottom 12, side walls 14 and 16, a rear wall 18 and a front wall 20. The bottom 12 may be of any suitable construction. Its main surface area is shown as having a grid-like configuration which is desirable from the standpoint of weight reduction and ease with which it may be cleaned. A marginal flange 22 extends along the four sides of the bottom and terminates at its lower edge in the plane of the undersurface of the container.

The side walls 14 and 16 are mirror images of one another. Each side wall extends vertically upwardly from the bottom 12 and has a lower vertical section 24 and an upper vertical section 26 spaced laterally outwardly from the lower section and joined thereto by a generally horizontal ledge 28. The upper sections 26 are spaced from one another a sufficiently greater distance than the lower sections 24 to permit nesting.

Figure 5:
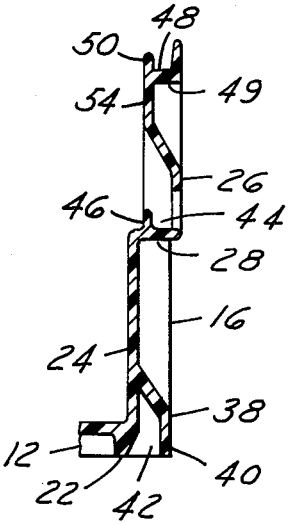
FIG. 5 is a sectional view taken on the line 5—5 in FIG. 1.
Figure 8:
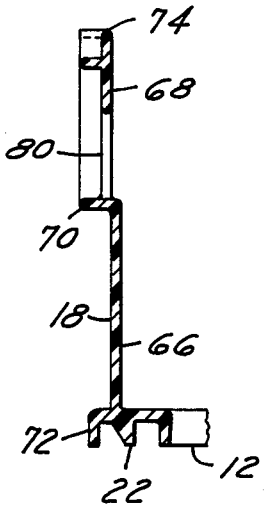
FIG. 8 is a sectional view taken on the line 8—8 in FIG. 2.

The container has a plurality of feet 38 equally spaced from one another along the lower edge portion of the lower section 24 of each side wall. The feet on one side of the container are directly opposite those on the other side. Each foot 38 extends outwardly and downwardly from the side wall as shown in FIG. 5 and terminates in a vertical portion 40 disposed laterally inwardly with respect to the plane of the upper wall section 26 so as to permit nesting as will become more apparent from the following description. The vertical portion 40 of each leg terminates at its lower end in the plane of the supporting surface of the bottom wall. Each foot has intermediate its length a transverse web 42 extending across the space between the foot and the side wall which cooperates to prevent relative longitudinal movement of two stacked containers as will appear more fully hereinafter.

The ledge 28 separating the upper and lower sections of each side wall has a plurality of horizontal nesting saddle portions 44 which are spaced apart longitudinally the same distance as the feet 38 and are positioned directly above the respective feet along both sides of the container. The saddles on one side of the container are directly opposite those on the other side and are spaced therefrom the same distance as the feet so as to support the feet of an upper container during nesting. Some of the nesting saddles have upwardly extending ribs 46 for a purpose which will become more apparent as the description proceeds. The ledge 28 also has horizontal saddle extensions 47 slightly above and forwardly of each of the saddles 44, except the forward-most one.

Each side wall has a plurality of horizontal stacking saddles 48 along the upper edge portion of the upper section 26 thereof which are spaced apart longitudinally the same distance as the feet 38 and are located directly above the respective feet. The spacing between the saddles 48 along each side wall is greater than the length of the feet 38 to permit the feet to clear the saddles for nesting. The stacking saddles comprise horizontal flanges 49 which extend inwardly from the upper section 26 of each side wall slightly below the horizontal upper edge thereof and terminate in upwardly directed flanges 50 whose upper edges are slightly below the upper horizontal edge of the side wall. These flanges 50 are notched intermediate their lengths where indicated at 52 to cooperate with the webs 42 of the feet of an identical container stacked thereon to restrain the upper container from movement in a lengthwise direction. The rear ends of saddles 48 are closed by flanges 51 extending across the space between flanges 50 and the side walls. The saddles on one side of the container are directly opposite those on the other side and are spaced therefrom the same distance as the feet so that the flanges 49 of the saddles support the flanges 40 of the feet during stacking.

Figure 7:
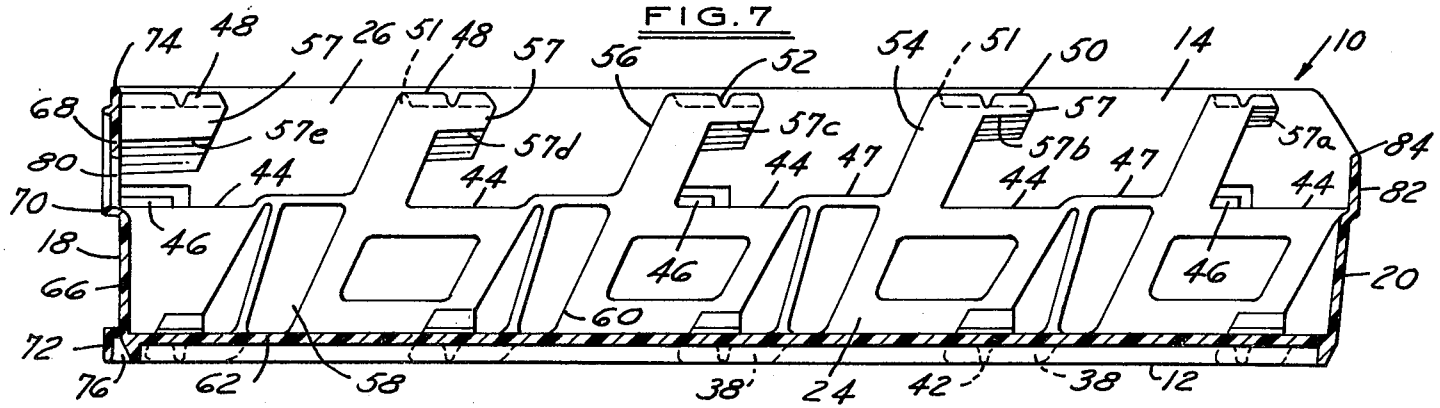
FIG. 7 is a sectional view taken on the line 7—7 in FIG. 2.
Figure 2:
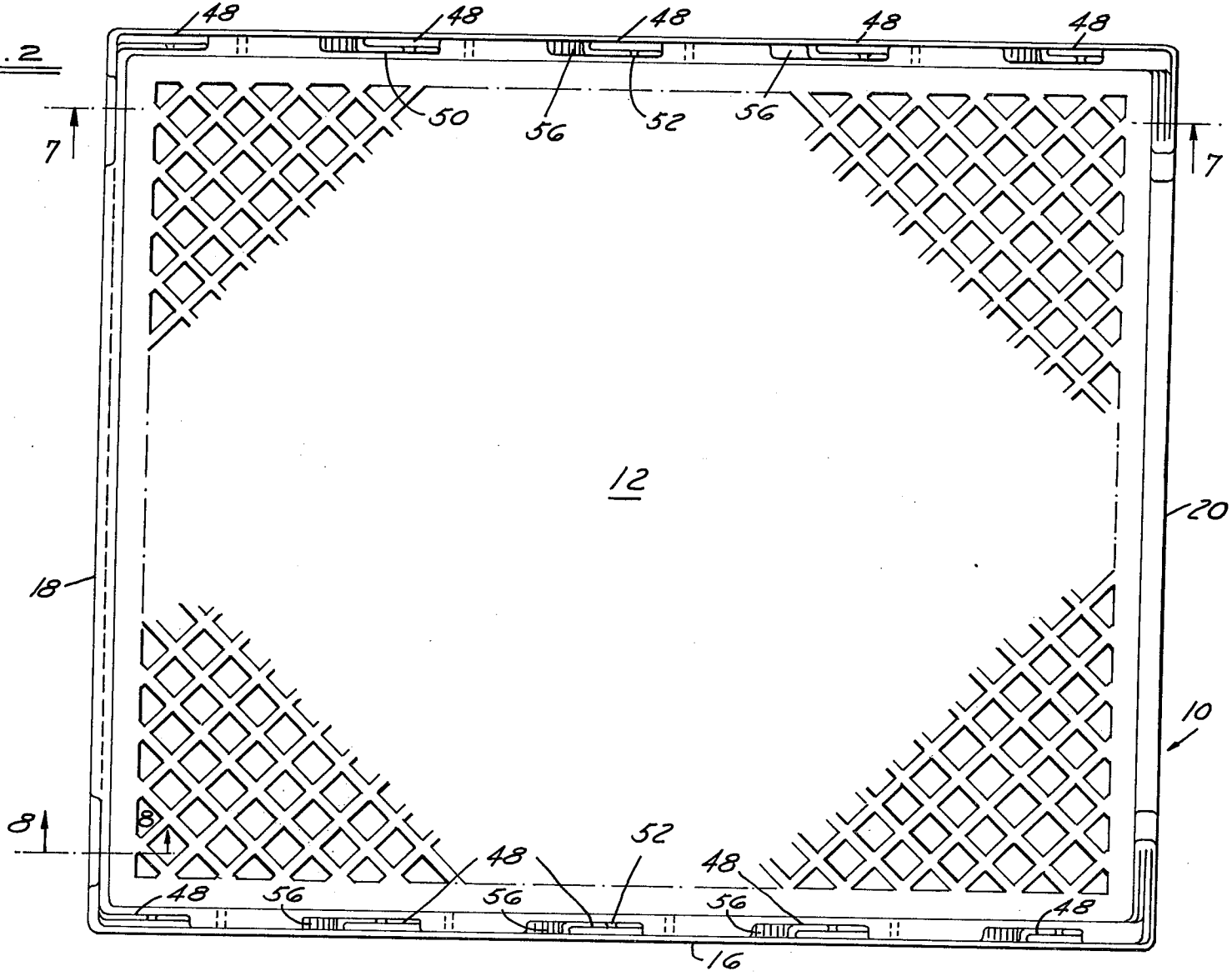
FIG. 2 is a top plan view of the container shown in FIG. 1.
Figure 3:
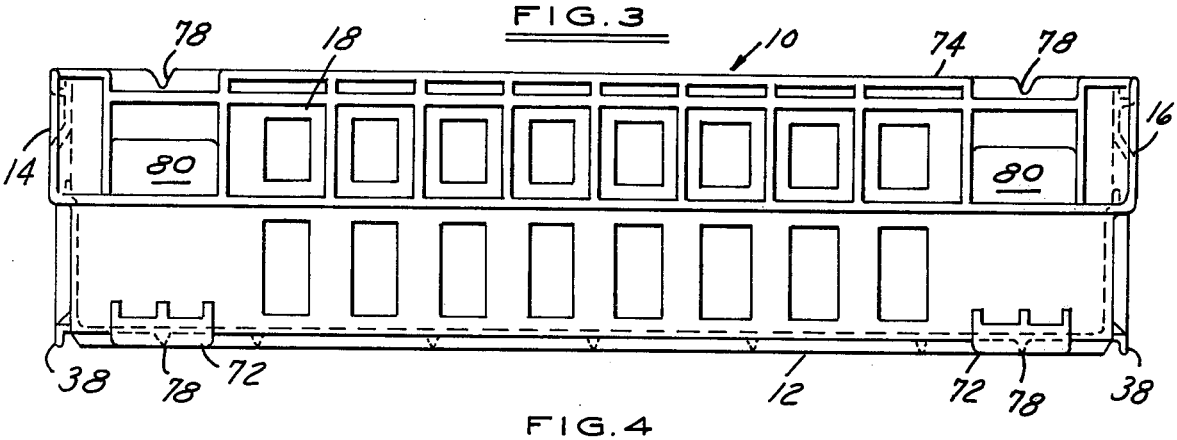
FIG. 3 is a rear elevational view of the container.
Figure 4:
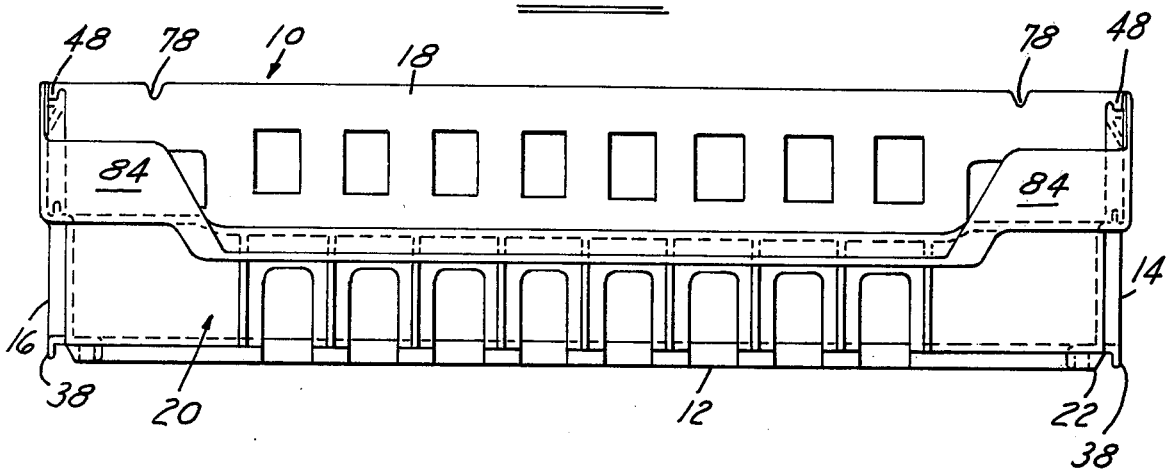
FIG. 4 is a front elevational view.
Figure 6:
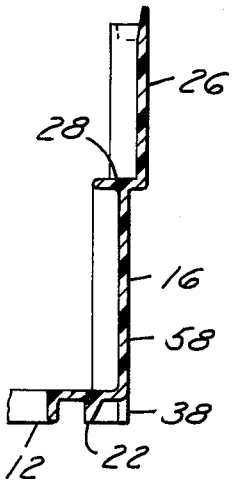
FIG. 6 is a sectional view taken on the line 6—6 in FIG. 1.
Figures 11, 12:
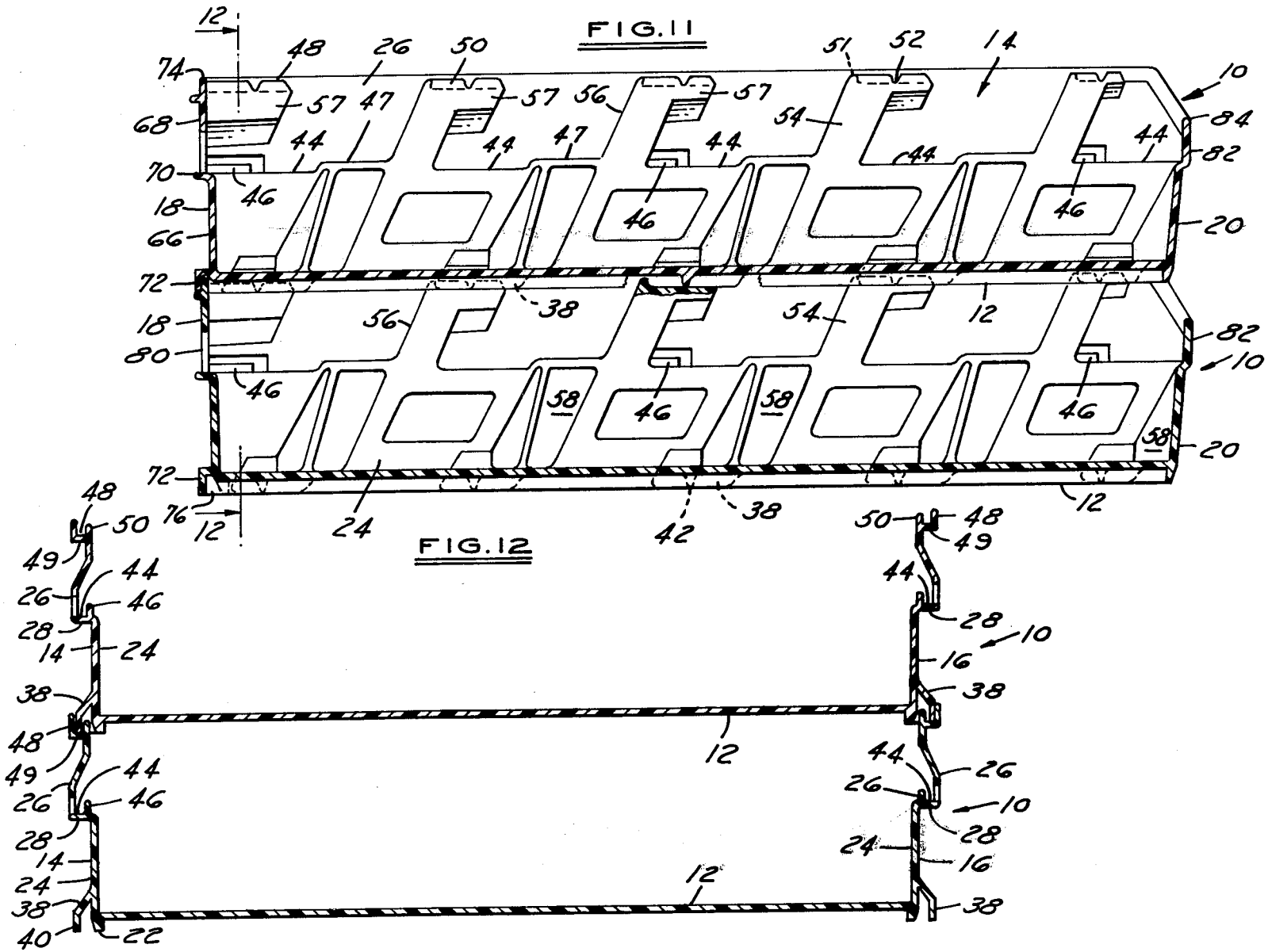
FIG. 11 is a sectional view showing two containers in a stacked relationship, the section being substantially on the line 7—7 in FIG. 2.
FIG. 12 is a sectional view taken on the line 12—12 in FIG. 11.

Each side wall 14, 16 has in its upper section a plurality of inwardly bulging integral rib formations 54 which extend downwardly to ledge 28 from the rear portion of each of the saddles 48 except the rearmost saddle. These ribs 54 are generally in the shape of a parallelogram and are inclined downwardly and rearwardly as shown in FIG. 1. Each defines a downwardly and rearwardly inclined ridge 56 the upper extremity of which connects with the rear end of one of the saddles 48. The ridges 56 are parallel to one another. Other inwardly bulged areas beneath the saddles 48 are indicated at 57. The ribs 54 and areas 57 bulge inwardly the same distance as saddles 48 are displaced inwardly (FIG. 5), and are coplanar with and form planar continuations of the flanges 50 of saddles 48 (see FIG. 11). The inwardly bulged areas 57 and ribs 54 form structural extensions of the saddles 48. They strengthen the side walls and increase the load-carrying ability of the saddles 48. The inwardly bulged areas 57 extend downwardly beneath the saddles progressively greater distances from front to rear of the container. The lower edges of these bulged areas in FIG. 7 are designated 57*a–e* to indicate these progressively greater distances. Such areas 57 then taper downwardly into the main plane of the side wall. The added clearance beneath areas 57 near the front is desired to facilitate movement of a container to a nested position. Those bulged areas 57 near the rear are deeper vertically for greater strength in that region. Should a tier or column of stacked containers be raised by a forklift truck, for example, this will normally be done from the rear to lift and tilt the tier rearwardly because of the slant of the ribs 54, and accordingly those saddles 48 near the rear should be strengthened by the bulged areas 57 as much as possible.

Figure 15:
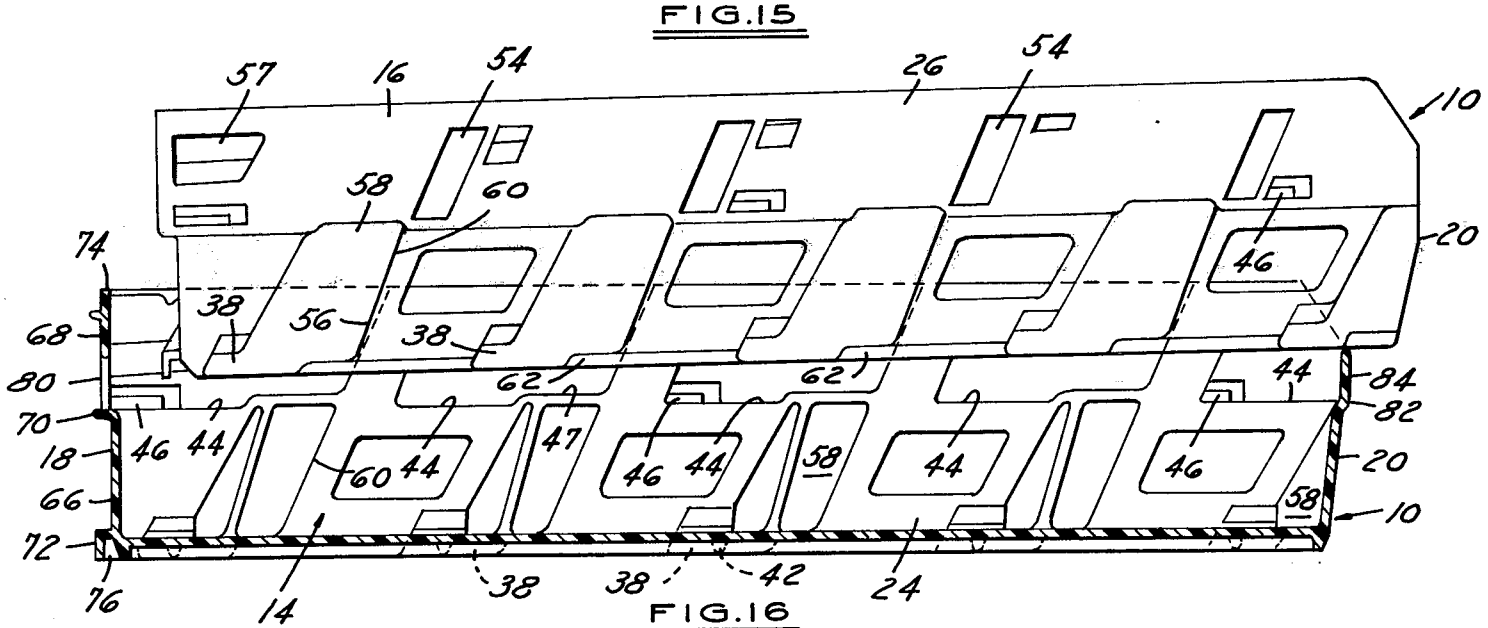
FIG. 15 is a view showing the lower container in section and the upper container in elevation during movement of the upper container toward a nested position.

The lower section of each side wall is formed with a plurality of laterally outwardly bulging ribs 58 which extend upwardly from each of the feet 38. The ribs 58 bulge outwardly the same distance as the feet 38 (FIG. 5) and are coplanar with and form planar continuations of the portions 40 of feet 38. (See FIG. 15). These ribs form structural extensions of the feet 38. They strengthen the side walls and increase the load-carrying capacity of the feet. Each rib 58, except the forward-most one, is generally in the shape of a parallelogram. The ribs 58 are slanted so as to be inclined downwardly and rearwardly, and each, except the forward-most one, define a ridge 60. The ridges 60 are parallel and are inclined similarly to the ridges 56. As seen in FIG. 1, each lower ridge 60 extends in a substantially straight line continuation of one of the upper ridges 56.

The lower ends of the ribs 58 have horizontal sections 62 spaced above the lower edge of the flanges 40 of feet 38 and constitute forward extensions thereof. These extensions 62 also have a piloting function during movement of an upper container toward a nested position, as will become apparent from the description which follows.

It will be noted in FIGS. 1 and 7 that the width of the ribs 54, that is their dimension measured in a direction lengthwise of the container, is less than the corresponding dimensions of the stacking saddles so that the side wall configuration of the upper side wall section 26 between ribs 54 is somewhat L-shaped. This feature, together with the slanting arrangement of the ribs 54 permits the nesting saddles 44 to be disposed directly under the stacking saddles 48 and in vertical alignment with the feet 38 so that an upper container either in a stacked or in a nested position will be in vertical alignment with the lower container. It will also be noted, particularly in FIG. 16, that the feet 38 together with the ribs 58 are L-shaped in order to fit in the L-shaped areas in the upper side wall sections 26 between ribs 54 during nesting.

The rear wall 18 of the container extends vertically upwardly from the bottom wall. The rear wall 18 has a vertical lower section 66 and a vertical upper section 68 displaced laterally outwardly, that is to the rear, with respect to the lower section to define a connecting ledge 70. At the lower edge of the lower section 66 there is a foot 72 which extends horizontally outwardly in a rearward direction and then terminates in a vertically downwardly extending flange. This foot 72 is intended to hook over the upper horizontal edge 74 of the rear wall of a lower container during stacking. A web 76 across the space between the downward flange portion of the foot 72 and the marginal flange 22 of the bottom wall of the container is adapted to fit in a recess 78 in the upper edge 74 of the rear wall of a lower container during stacking to locate the upper container and restrain it from movement. During nesting, these feet 72 extend into openings 80 formed in the upper section of the rear wall of a lower container.

The front wall 20 of the container flares outwardly, that is in a forward direction, slightly, and has a laterally outwardly offset upper portion 82 which is cut down substantially throughout the major mid-portion of its length. The side edge portions 84 of this upper section of the front wall however are of substantial height, cut down only slightly from the elevation of the side walls to provide ample reinforcement and support for the side walls.

In order to stack two of the containers 10, one upper container may be held horizontally over another similarly oriented container and lowered directly into a stacked position in which the vertical portions 40 of the feet 38 come to rest on the horizontal flanges 49 of the stacking saddles 48. In this position, the flanges 72 along the rear of the upper container hook over the upper edge of the rear wall of the lower container to provide added support and to prevent relative longitudinal movement. Webs 42 engaging notches 52 also prevent relative longitudinal movement. The feet 38 fit inside the upper edges of the side walls of the lower container and webs 76 fit into the notches 78 in the rear wall of the lower container to prevent relative lateral movement. The containers are thus stacked in a vertically in-line position with respect to one another. The ribs 54 and bulged areas 57 strengthen the saddles 48 and the ribs 58 strengthen the feet 38 so that a higher tier of stacked containers is permitted.

Stacking may also be accomplished by tipping the upper container down and to the rear when lowering so that the flanges 72 are the first portions of the upper container to contact the lower container by hooking over the upper edge of the rear wall of the latter. Then the upper container may be swung about the upper edge of the rear wall of the lower container as a pivot into a stacked position in which the feet of the upper container rest upon the saddles of the lower container.

The upper container may if desired be rotated 180° with respect to the lower container and stacked thereon in a vertically in-line position since the feet on one side of an upper container will just as easily engage and rest upon the saddles on the opposite side of a reversed lower container. Of course when the upper stacked container is turned 180°, the flanges 72 have no function.

In order to nest two containers 10, they must be similarly oriented and the upper container should first be held over the lower container and moved longitudinally in a forward direction approximately the distance of the spacing between the feet so that the rearmost feet of the upper container engage the second set of saddles from the rear wall and so on. In this position, the lower edges of the vertical portions 40 of the feet slidably engage the flanges 51 of the saddles. The upper container can then be slid horizontally rearwardly until the feet move off of the saddles whereupon the upper container drops slightly and pilot feet extensions 62 will engage the flanges 51.

Further horizontal rearward movement of the upper container causes the feet to drop off saddle flanges 51. The ridges 60 of the upper container will then engage the ridges 56 of the lower container to guide the initial descent of the upper container in a downward and rearward direction at the angle of these ridges. During this initial descent, the upper container remains horizontal until its bottom comes into contact with the portions 84 of the front wall of the lower container. Further descent of the upper container will proceed at an angle to the horizontal as viewed in FIG. 15 because the front of the container remains hung up on the front wall of the lower container.

Figure 13:
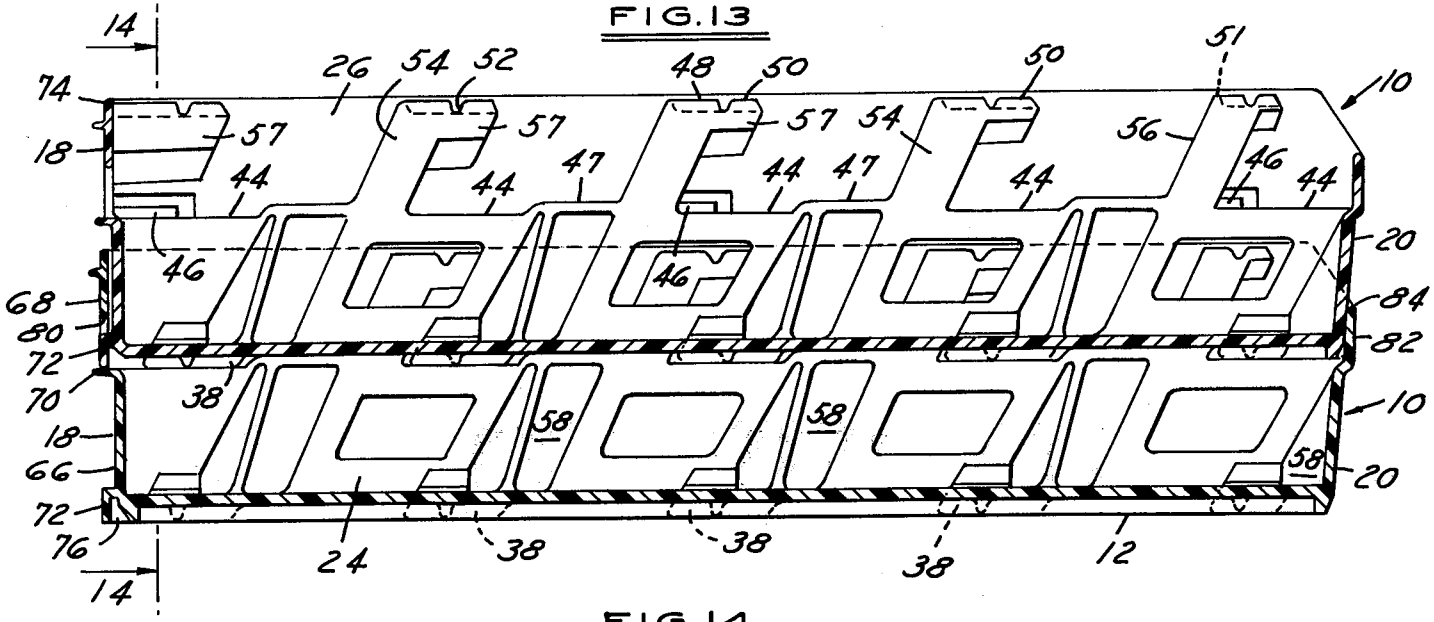
FIG. 13 is a sectional view of two containers in a nested relationship taken substantially on the line 7—7 in FIG. 2.
Figure 14:
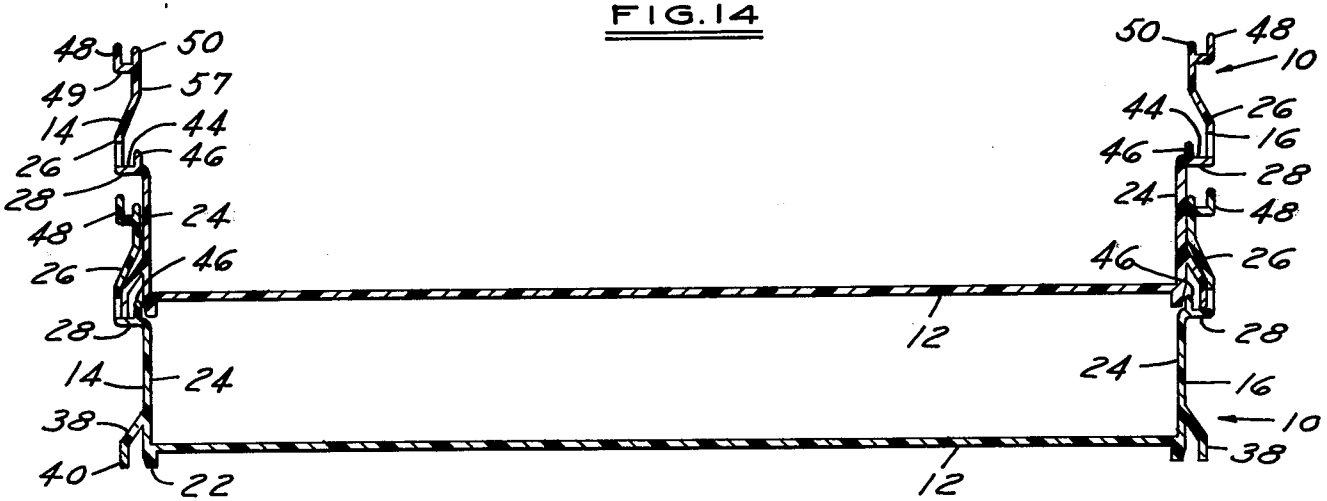
FIG. 14 is a sectional view taken on the line 14—14 in FIG. 13.
Figure 16:
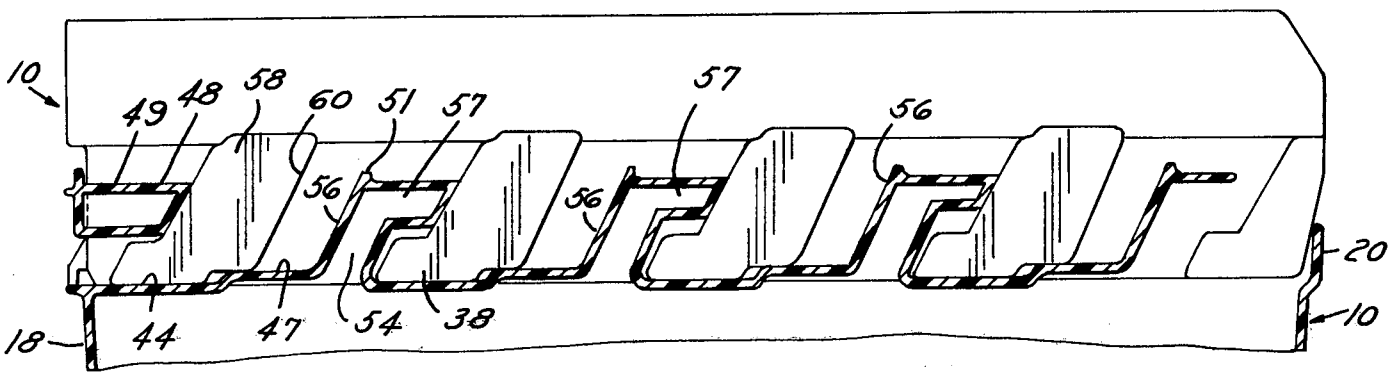
FIG. 16 is a semi-diagrammatic view to depict nesting.

Continued rearward and downward movement of the upper container will bring the rearmost feet of the upper container into engagement with the nesting saddles 44, after which the front of the upper container drops inside the front wall of the lower container to a full in-line nested position shown in FIGS. 13 and 16 in which all of the feet are supported on the respective nesting saddles. In this position, the feet extensions 62 rest upon the nesting saddle extensions 47 for increased strength of support and flanges 46 extend inside the feet as seen in FIG. 14. Openings 80 in the lower container clear the flanges 72 of the upper container. The added support supplied by the saddle and foot extensions 47 and 62 during nesting permits more containers to be nested in a tier without placing undue strain on the lower containers. The ribs 58 strengthen and reinforce the feet 38 and extensions 62.

As stated above, the inwardly bulged areas 57 beneath the saddles are of progressively reduced vertical dimension towards the front of the container. This is to facilitate movement to nested position along the slanting line indicated in FIG. 15 while retaining a reasonably high front wall as shown at 84. If the front bulged areas 57 were of the same vertical dimension as those at the rear, the front feet of the upper container, when moved toward nesting, would not readily enter under the front bulged areas 57 of the lower container unless the front wall of the lower container were cut very low. That would be undesirable because a high front wall strengthens and provides better support for the side walls.

What we claim as our invention is:

1. A stack and nest container having a bottom, side walls projecting upwardly from opposite side edges of said bottom, said side walls each having a lower section and an upper section spaced outwardly from said lower section joined thereto by a ledge, said upper wall sections being spaced apart sufficiently farther than said lower wall sections to permit said container to nest in a lower container of identical construction, said container having a plurality of feet spaced from one another along the outer side of the lower edge portion of the lower section of each side wall, said ledges having nesting saddle portions directly above said feet adapted to support the feet of an upper identical container nested therewith, and a plurality of stacking saddles directly above said feet along the inner side of the upper edge portion of the upper section of each side wall to support the feet of an upper identical container stacked thereon, said stacking saddles along each upper edge portion being spaced from one another sufficiently to clear the feet of an upper identical container for nesting, said side walls having guide means for guiding the feet of an identical container down to said nesting saddle portions, said guide means including upper ribs projecting inwardly from the inner surface of the upper section of each side wall, said upper ribs having upper ridges respectively extending downwardly from points adjacent the rear ends of certain of said stacking saddles to points adjacent the front ends of certain of said nesting saddle portions, said guide means also including lower ribs projecting outwardly from the outer surface of the lower section of each side wall, said lower ribs having lower ridges respectively extending upwardly from points adjacent the front ends of certain of said feet to points adjacent the front ends of certain of said nesting saddle portions, said upper ridges cooperating with the lower ridges of an identical upper container to guide the latter during movement thereof to a nesting position.

2. A container as defined in claim 1, including an end wall projecting upwardly from said bottom and having complementary formations at the upper and lower edges thereof, said upper edge formations being engageable with the formations at the lower edge of the end wall of an upper identical container during stacking to restrain said upper container from relative longitudinal movement.

3. A container as defined in claim 1, wherein said upper and lower ridges are inclined at substantially the same angle.

4. A container as defined in claim 1, including means for restraining relative movement between said container and another identical container stacked thereon.

5. A container as defined in claim 1, including an end wall projecting upwardly from said bottom and having hook means at the upper edge thereof and complementary hook engaging means at the lower edge thereof, said hook means being engageable with the hook engaging means at the lower edge of the end wall of an upper container during stacking to restrain said containers from relative longitudinal movement.

6. A container as defined in claim 1, wherein said stacking saddles and said feet have complementary formations, said stacking saddle formations being engageable with the formations on the feet of an upper identical container during stacking to restrain said upper container from relative lateral and longitudinal movement.

7. A container as defined in claim 1, wherein said upper ribs form structural extensions of certain of said stacking saddles, said lower ribs forming structural extensions of certain of said feet, said upper and lower ridges being inclined at the same angle.

8. A container as defined in claim 7, wherein said stacking saddles have extended portions extending laterally beyond the upper ends of said upper ribs in one direction longitudinally of the container to form with said upper ribs generally L-shaped spaces between adjacent stacking saddles and upper ribs, said feet having extended portions extending laterally beyond the lower ends of said lower ribs in the opposite direction longitudinally of said container to form with said lower ribs generally L-shaped formations adapted to fit in said generally L-shaped spaces during nesting.

9. A container as defined in claim 8, wherein said extended portions of said stacking saddles adjacent one end of said container are of reduced vertical dimension relative to the extended portions of the stacking saddles adjacent the opposite end of the container to facilitate the movement of an upper container to a nested position with respect thereto.

10. A container as defined in claim 8, wherein the extended portions of said stacking saddles from the rear of the container to the front therof are of progressively reduced vertical dimension to facilitate the movement of an upper container to a nested position with respect thereto.

* * * * *